US009072386B2

(12) United States Patent
Solheim

(10) Patent No.: US 9,072,386 B2
(45) Date of Patent: Jul. 7, 2015

(54) SITTING ARRANGEMENT

(75) Inventor: Albert Solheim, Ikornnes (NO)

(73) Assignee: Ekornes ASA, Ikornnes (NO)

( * ) Notice: Subject to any disclaimer, the term of this patent is extended or adjusted under 35 U.S.C. 154(b) by 285 days.

(21) Appl. No.: 13/497,001

(22) PCT Filed: Oct. 19, 2010

(86) PCT No.: PCT/NO2010/000369

§ 371 (c)(1),
(2), (4) Date: May 16, 2012

(87) PCT Pub. No.: WO2011/049461

PCT Pub. Date: Apr. 28, 2011

(65) Prior Publication Data

US 2012/0217777 A1 Aug. 30, 2012

(30) Foreign Application Priority Data

Oct. 19, 2009 (NO) ..... 20093164

(51) Int. Cl.
*A47C 17/04* (2006.01)
*A47C 7/02* (2006.01)
*A47C 1/023* (2006.01)

(52) U.S. Cl.
CPC ..... *A47C 17/04* (2013.01); *A47C 1/023* (2013.01)

(58) Field of Classification Search
CPC ..... A47C 17/04; A47C 3/025; A47C 7/14; A47C 7/02
USPC ..... 297/313, 337, 68, 423.3; 5/618
See application file for complete search history.

(56) References Cited

U.S. PATENT DOCUMENTS

| | | | | |
|---|---|---|---|---|
| 633,087 | A * | 9/1899 | Johnson | 297/313 |
| 1,678,071 | A | 7/1928 | Muller | |
| 1,790,435 | A * | 1/1931 | Muller | 5/618 |
| 2,716,566 | A | 8/1955 | Thiry | |
| 2,746,520 | A * | 5/1956 | Ducrot | 297/322 |
| 3,512,831 | A * | 5/1970 | Flint | 297/309 |
| 3,712,666 | A * | 1/1973 | Stoll | 297/61 |
| 3,974,530 | A * | 8/1976 | Lusch et al. | 5/618 |
| 4,277,858 | A * | 7/1981 | Bohme | 5/618 |
| 5,217,276 | A * | 6/1993 | LaPointe et al. | 297/85 L |

(Continued)

FOREIGN PATENT DOCUMENTS

| | | |
|---|---|---|
| DE | 29800216 U1 | 11/1998 |
| GB | 437114 | 10/1935 |

(Continued)

OTHER PUBLICATIONS

International Search Report, Int'l. Application No. PCT/NO2010/000369, Mailing Date: Dec. 27, 2011; 11 pages.

(Continued)

*Primary Examiner* — David R Dunn
*Assistant Examiner* — Tania Abraham
(74) *Attorney, Agent, or Firm* — Seyfarth Shaw LLP

(57) ABSTRACT

A sitting arrangement (1) is disclosed. Said sitting arrangement includes a support frame (2), seat part (4) and backrest (3). The seat part (4) is articulately connected to the support frame (2) in at least one mounting mechanism (8*a, b*) located below a sitting surface of the seat part (4). At least one balance spring (14) is mounted between the seat part (4) and the support frame (2). The sitting arrangement may be used as an element of a chair, settee or longseat.

7 Claims, 8 Drawing Sheets

(56) References Cited

U.S. PATENT DOCUMENTS

| | | | | |
|---|---|---|---|---|
| 5,716,099 | A * | 2/1998 | McDiarmid | 297/302.1 |
| 6,168,233 | B1 | 1/2001 | Markus | |
| 7,073,860 | B2 * | 7/2006 | Markus | 297/316 |
| 7,722,119 | B1 * | 5/2010 | Delmestri et al. | 297/313 |

FOREIGN PATENT DOCUMENTS

| | | |
|---|---|---|
| GB | 513387 | 10/1939 |
| WO | WO 2011/049461 | 4/2011 |

OTHER PUBLICATIONS

International Search Report, Int't Appl.l No. PCT/NO2010/000369; Mailing Date: Apr. 15, 2011; 13 pages.

Norwegian Search Report: Patent Application No. 20093164; Date of Report: Mar. 16, 2010; 2 pages.

* cited by examiner

SITTING ARRANGEMENT

This application is a U.S. National Phase of International Patent Application Serial No. PCT/NO2010/000369 filed Oct. 19, 2010, and claims priority to Norwegian Application Serial No. NO 20093164 filed Oct. 19, 2009.

FIELD OF THE INVENTION

The present invention relates to a sitting arrangement for a settee, armchair or longseat (chaise longue) or similar. In particular, it relates to a sitting arrangement with an adjustable or tilting seat.

BACKGROUND

From DE 10200401 A1 there is known a settee wherein a seat may be tilted with an elevation arrangement at the back edge of the seat. However, this tilting mechanism is only suited for converting a seat into a tilted pillow acting as a back support.

Further, in some models of the StressLess series of settees produced by the present applicant, there are curved sliding guides in the seat and back allowing each seat part to be pushed into a more backward position or into a more raised position.

However, all prior art solutions are quite complicated with many cooperating elements. This contributes to an expensive production and thus a high price on the product, and may limit the "comfort range" of the product, i.e. in which positions it is comfortable for a user to sit or lie down on a settee.

SUMMARY OF THE INVENTION

It is an object of the invention to provide a settee or other sitting/reclining furniture that has an improved comfort with a tilting seat, without restricting the number of comfortable user positions, or appreciably raising the price of the product.

This is achieved in a sitting arrangement according to claim 1, which is suited for being incorporated in a settee, armchair or longseat.

BRIEF DESCRIPTION OF THE DRAWINGS

The invention will now be further described by means of the embodiments in the appended drawings, in which.

DETAILED DESCRIPTION

Figure 1:
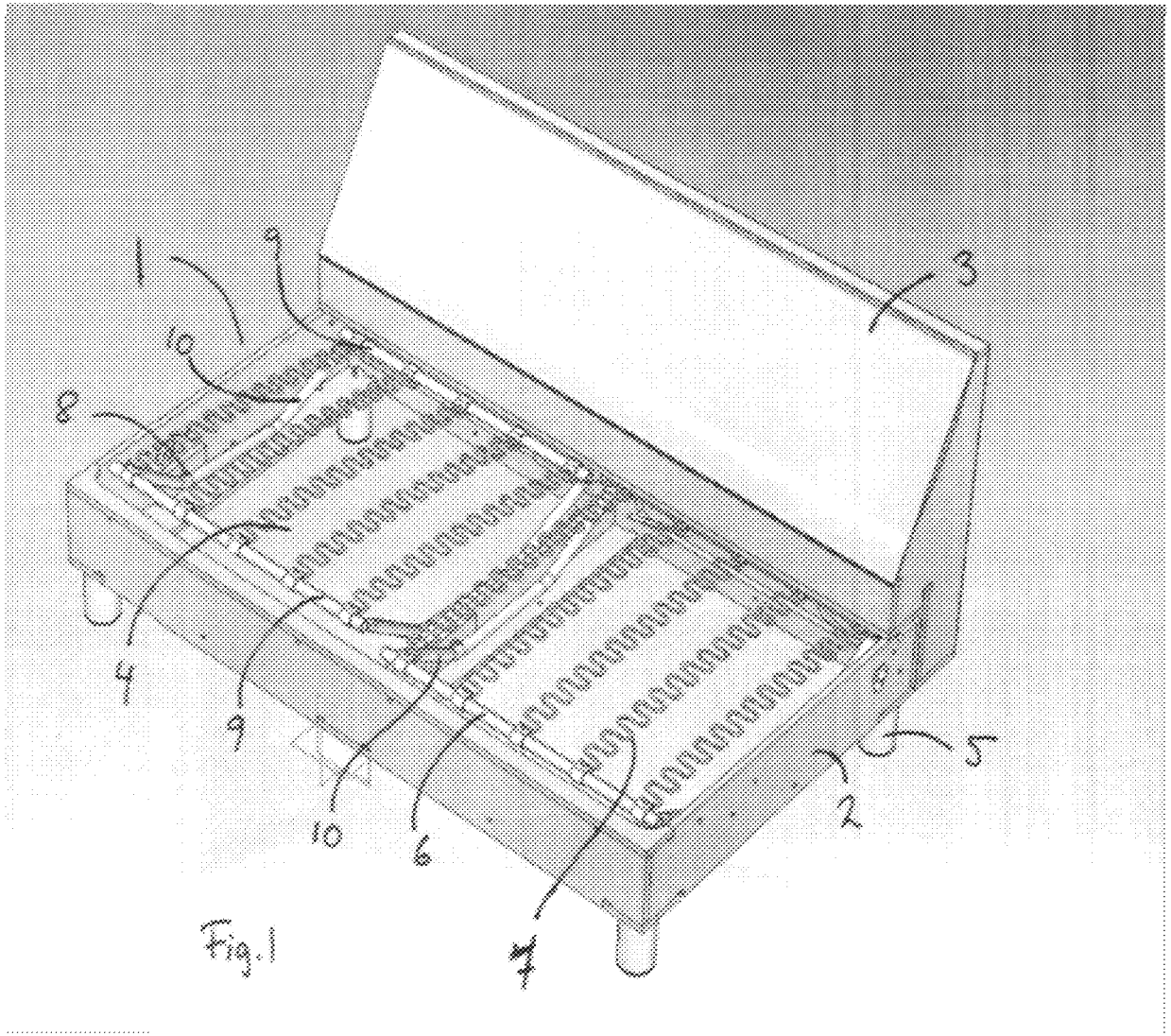
FIG. 1 is a perspective view of a sitting arrangement with tilting seat, with the bolstering removed.

FIG. 1 shows a sitting arrangement according to the invention. In the figure, two sitting arrangements are mounted side-by-side forming a two seat settee. The invention relates to a sitting arrangement that may be incorporated in any sitting furniture as a core component. In the figure, only the framework, seat part and backrest are shown. When incorporated in a chair or settee, it will of course be provided with sides, bolstering, pillows, etc.

The sitting arrangement 1 includes a support frame 2, backrest 3 and a seat part 4. The support frame 2 is composed of four vertical plates forming a rectangular box with open top and bottom. This support frame is intended for mounting the components forming the furniture on, such as the seat part 4, backrest 3, legs 5, etc.

Thus, each support frame includes first and second side elements 2*a, b*, and front and back frame elements 2*c, d*.

The seat part 4 includes a seat frame 6, seat springs 7 and at least one articulated mounting mechanism. In this embodiment, the seat frame 6 is shaped as a square with four sides made up of two mainly straight parallel front and rear bars 9*a, b*, of which one is adjacent to the backrest 3 and the other is parallel with this along the front side of the frame, and two angular or curved parallel sidebars 10*a, b*. The seat springs 7 span the seat frame 6 between the front and rear bars 9*a, b* forming a springy surface for a pillow or similar. The mounting mechanism is here realized as two articulated mounting devices 8*a, b* mounted on the side elements 2*a, b* for fastening the seat part 4 to the support frame 2. In the embodiment shown in the figure, the seat frame includes a third cross bar 10*c* which protrudes outside the circumference of the seat frame, and wherein the ends of said cross bar are suspended in mounting devices 8*a, b* on the support frame. The mounting devices are realized as bearing blocks produced from a suitable material, such as wood or metal, but preferably from plastic. The cross bar is stiffening the seat frame. However, another option is to weld short pipe fittings to the seat frame, which engage the mounting devices.

In the embodiment shown on the figure, the mounting devices 8*a, b* are mounted asymmetrically to the seat part 4 compared with a central axis through the seat part so that the hinge line will be located between the knees and hip of a user sitting on the sitting arrangement in an ordinary way with parallel legs and the back against the backrest. The mounting devices may e.g. be mounted one third of the distance from the front of the seat. The invention aims to locate the mounting devices so that a self-balancing tilting seat is achieved. Preferably, the mounting devices are not equipped with locking means or brakes, as the tilt is delimited by the mounting devices and their location combined with springs.

Further, the mounting mechanism is arranged to obtain a mainly horizontal seat angle of the seat part when a user is lying on it, but will tilt downwards at the rear when the user is seated. The seat part will tilt downwards, i.e. towards the backrest, with a seat angle larger than 0 degrees, preferably between 0 and 10 degrees, more preferably between 3 and 7 degrees, between 2 and 6 degrees, between 4 and 8 degrees or between 4 and 6 degrees, and most preferably about 5 degrees compared with a horizontal surface.

The self-balancing arrangement of the seat angle will increase the feeling of comfort for a user both when seated and when lying down.

Figure 2:
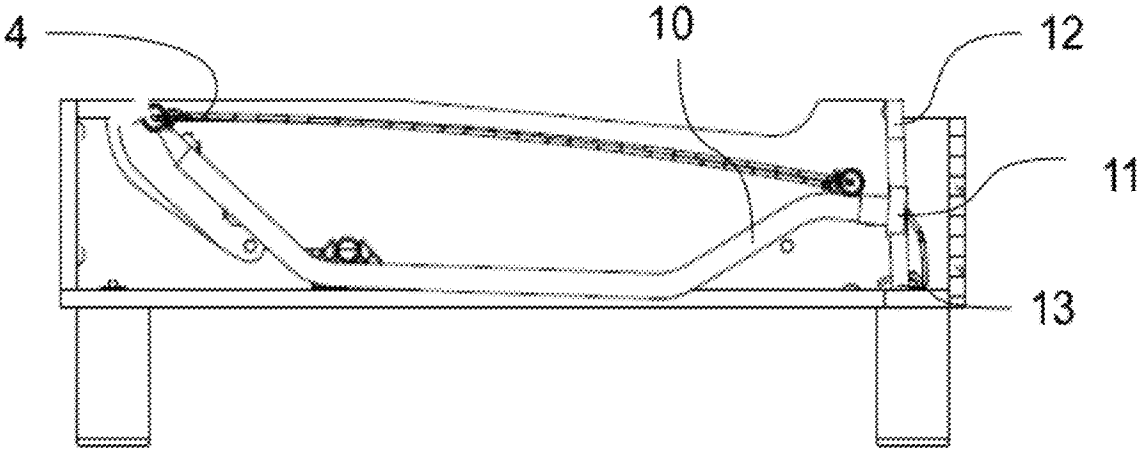
FIG. 2 is a side view of the sitting arrangement, with the side wall removed.
Figure 3:
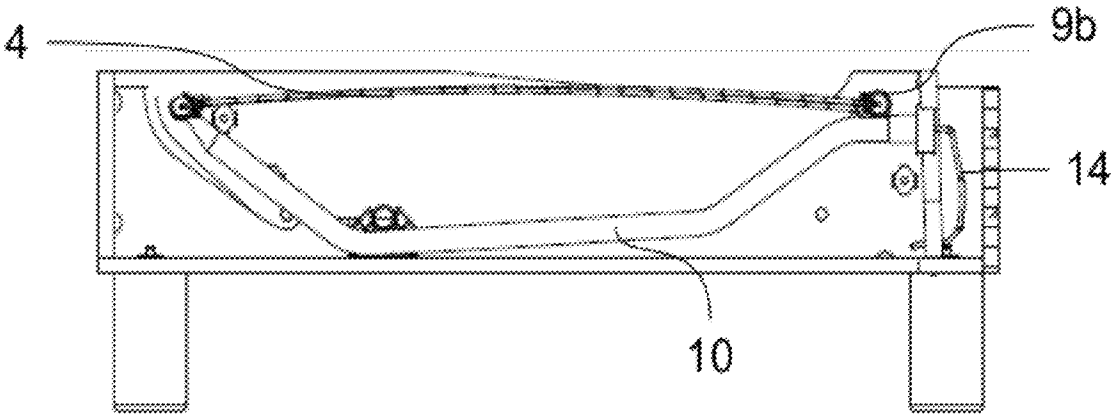
FIG. 3 is a corresponding side view, with the seat tilted downwards.

FIG. 2 shows the inventive sitting arrangement in side view, with the side wall of the support frame removed. The curved sidebars 10*a, b* include end parts 11*a, b* protruding outside the seat frame at the rear. The end parts 11*a, b* are each arranged between two end stops or surfaces 12, 13 located below the backrest. The end stops 12, 13 define the angular range of the tilt of the seat part 4 as the sidebars will rest against the upper end stop 12 in a horizontal position and against the lower end stop 13 when the seat part is tilted downwards at the back. However, the seat part 4 may also come to rest in positions between the end stops if this provides equilibrium for the user.

Figure 4:
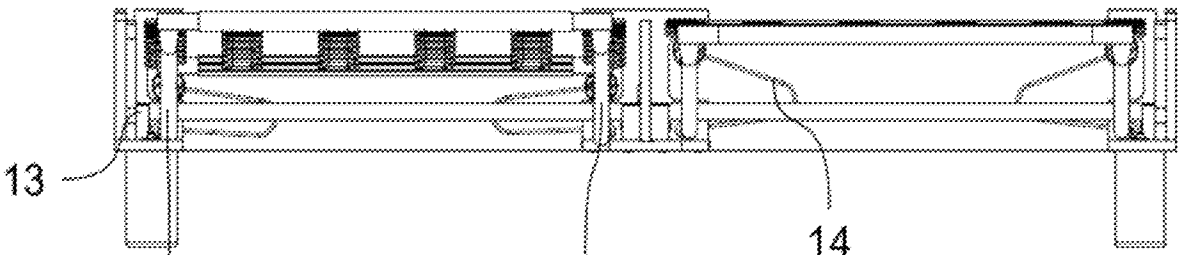
FIG. 4 is a front view of the sitting arrangement.
Figure 5:
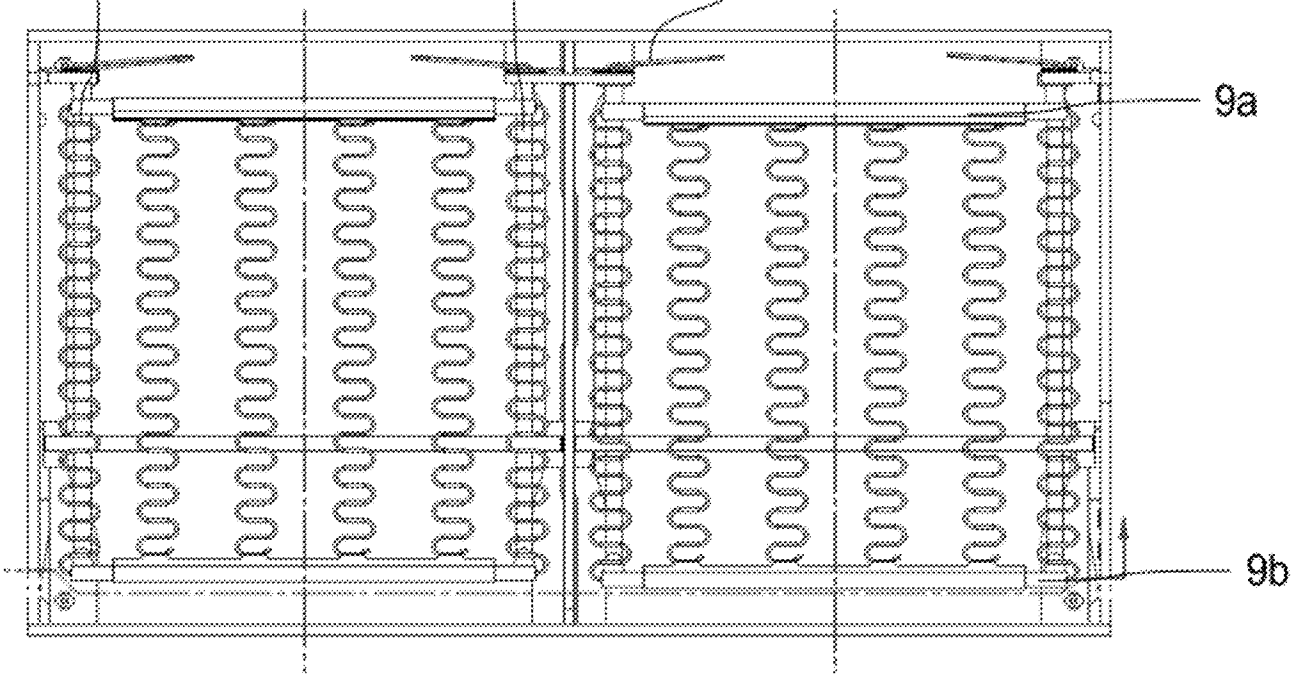
FIG. 5 is a view of the sitting arrangement from above.

FIG. 4 is a front view of the tilting seat part 4. In the sitting arrangement shown at left, the seat part 4 is tilted downwards, while the seat part of the arrangement at right is horizontal. One or more balancing springs 14 are mounted between the support frame and either the side bars 10*a, b* or the rear bar 9*b*. When the seat part is not loaded or not loaded sufficiently to change the balance, the balance springs 14 will press the seat part 4 into a horizontal position. Here, horizontal positions means an unloaded or passive position in which the seat is lying in the position it will take when the sitting arrangement is unoccupied. Please note that the seat part may be arranged to take a predefined angle from the horizontal when it is in a passive position.

In the embodiment shown in FIG. 4, there is provided a balance spring 14 below each end part of the sidebars 10*a, b*. The spring is mounted below the lower end stop 13 and the end part of the sidebar, respectively. When the seat part 4 is loaded, the part located at the back will be pressed down and compress the springs. Thus, the seat part will be tilted downwards against the backrest 3 with a certain resistance. The user will get a feeling of "sinking" into the sitting arrangement, which will increase the feeling of relaxation and comfort. Should the user want to lie down (we here presuppose that the sitting arrangement is included in a settee composed of several sitting arrangements chained together), the weight distributed from the user on the seat part 4 will be changed, i.e. the user's centre of mass will be offset in such a way that the resistance from the balance springs 14 will press the seat part 4 upwards and recreate a mainly horizontal surface of several seat parts, which will be comfortable to lie on, e.g. for an after-dinner nap.

Instead of using angular balance springs, as shown on the figures, coil springs, leaf springs or an elastic arrangement may be used. A single spring may also be used, either located at the middle of the rear bar or offset from the middle location. The balance springs may also be located at, and/or combined with, the mounting arrangement, e.g. as torsion springs.

In an optional embodiment (not shown) the mounting mechanism includes one or more hinges mounted on the seat part (on its underside), the hinge(s) gripping a bar spanning the support frame between the side elements.

Figure 6:
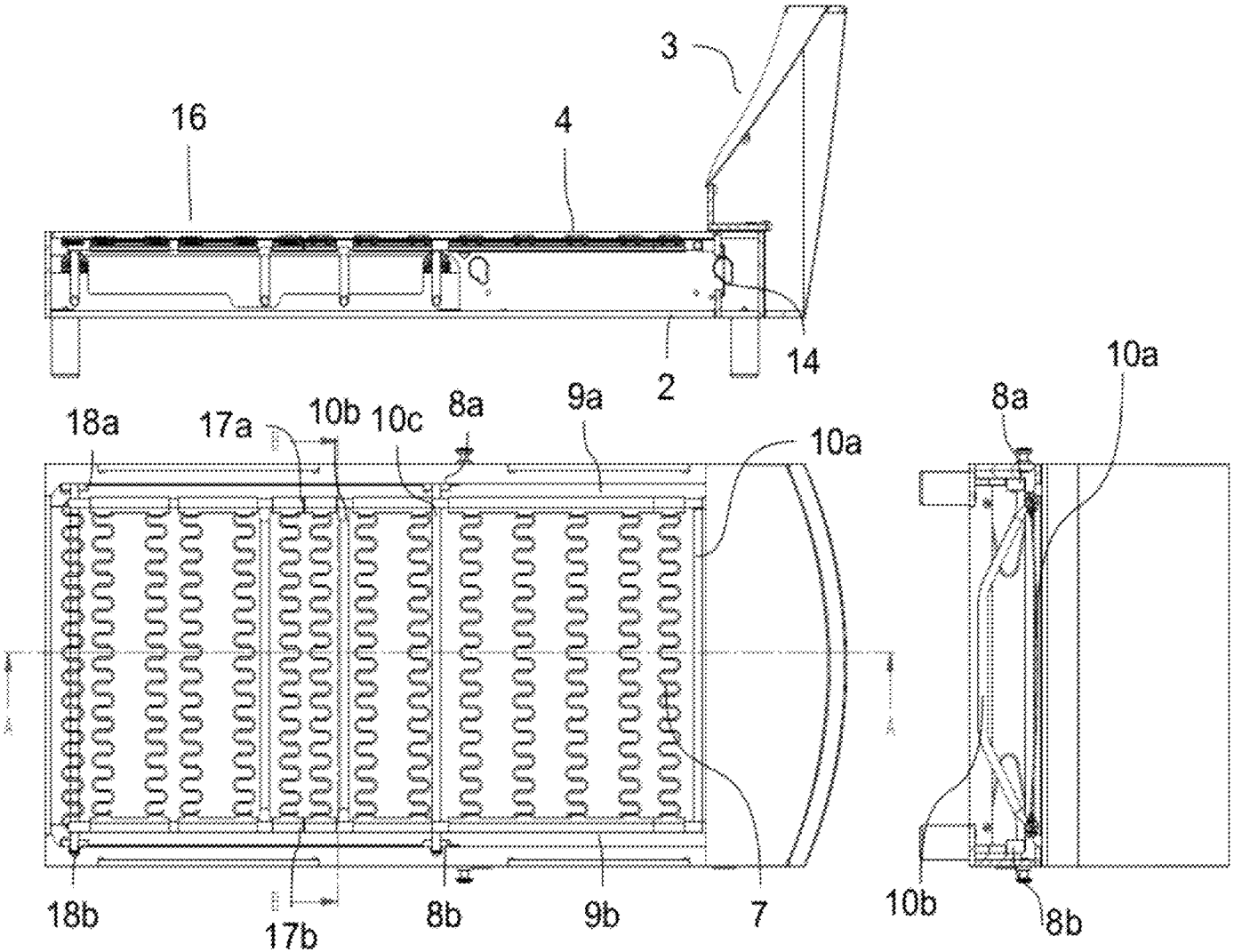
FIG. 6 shows a longseat employing the inventive sitting arrangement, in plan view, longitudinal section and in side view; the longseat is shown without any bolstering, and with the seat in a first, flat position.

As mentioned above, the inventive sitting arrangement may be included in several types of furniture. FIG. 6 shows a longseat employing said sitting arrangement. At the front of the seat part there is attached a flap 16, in hinge points 17*a, b*. In its opposite end, the flap is also attached to the support frame 2, in articulated mounting points 18*a, b*. When the seat part 4 is tilting in one direction, the flap 16 will tilt in opposite sense and thus form a break in the sitting surface and a bump near the knees of a user occupying the longseat. If the user chooses to lie down on the longseat, the seat part will return into a passive position forming a straight continuous sitting surface suited for a person lying down, several seated persons, or persons partially slung on the longseat.

Figure 7:
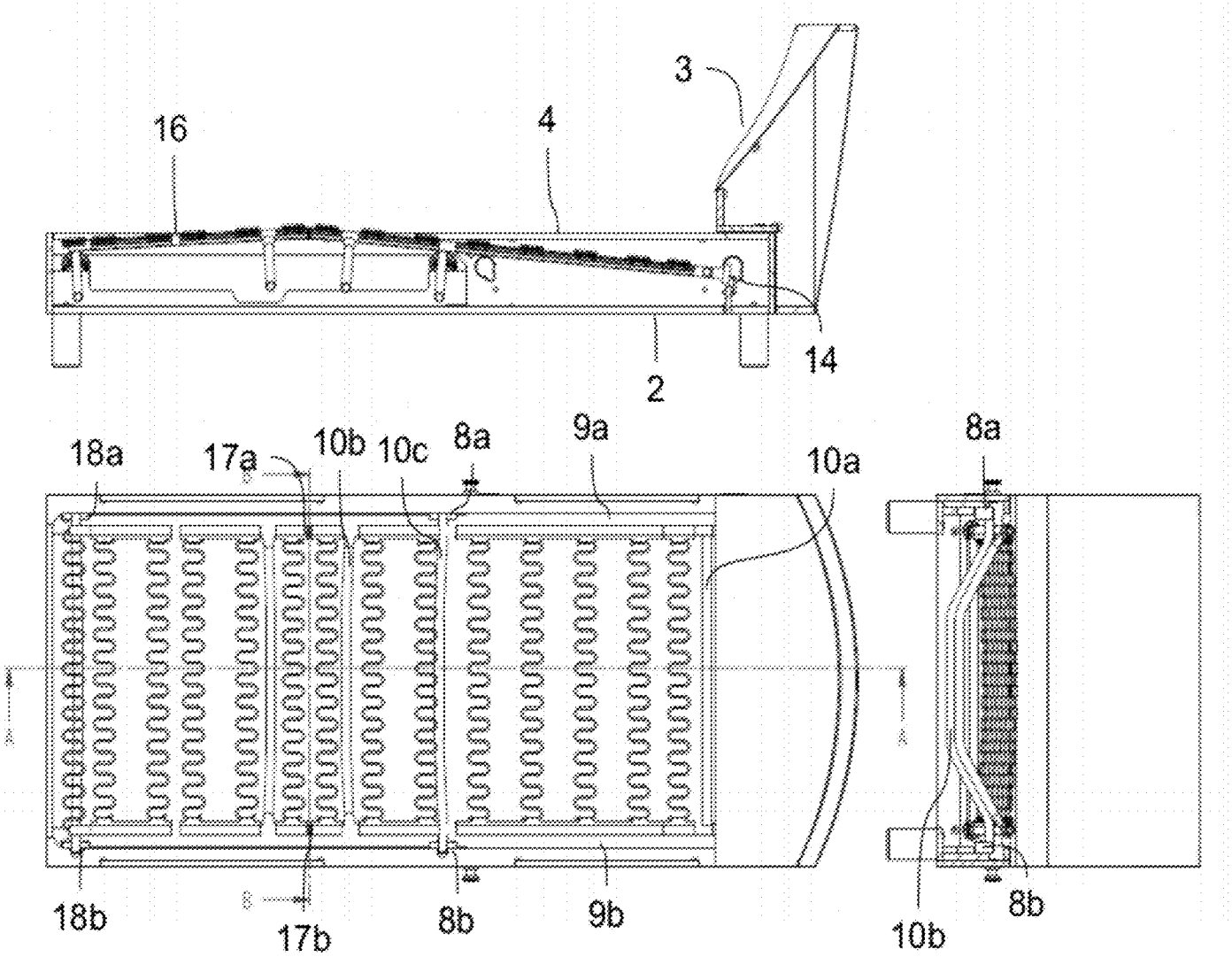
FIG. 7 shows the longseat with the seat in a second position.

FIG. 7 shows the longseat with the seat part 4 in a second position, in which the seat part is tilted downwards towards the backrest 3. When tilting the seat part, the rear bar 9*b* adjacent to the backrest 3 will tilt downwards, while the front bar 9*a* adjacent to the flap 16 will tilt upwards. Thus, the flap 16 will tilt upwards near the seat part 4 and rotate about articulated mounting means 18*a, b* whereupon the flap 16 and the seat part 4 meets at an angle exceeding 0 degree. This will e.g. be the situation when somebody sits up against the backrest 3.

Compared to prior art solutions, a chaise longue or longseat according to the present solution characterized in that the seat and the flap are hinged together in hinge points 17*a, b* and furthermore articulately suspended independently at opposing ends. Thus, when the seat and flap are tilted, the assembly must be expandable to allow this tilting. Preferably, this expansion is provided in the hinge points 17*a, b* between the seat part and the flap. In a first embodiment, the hinges may be conventional, with two-part hinges with tubular ends for installation in the seat frame and a corresponding frame inside the flap. Each hinge may be fixed to a frame in a first end, and be allowed to slide freely inside the tubular frame in the other end. Both ends may also be allowed to slide freely. The frames will therefore slide apart slightly in the hinge points when the seat is tilted upwards.

Figure 8B:
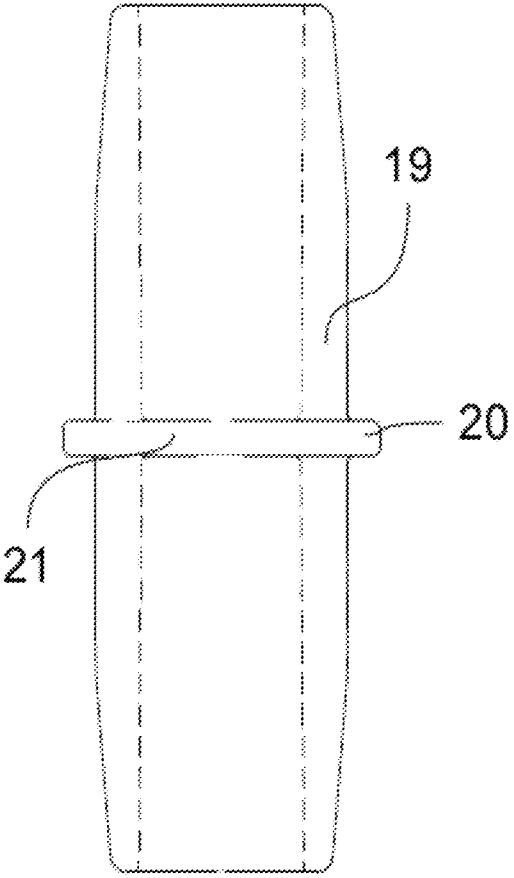
FIG. 8 shows a detail of the longseat; an elastic joint incorporated therein, a in perspective view and b in section.
Figure 8A:
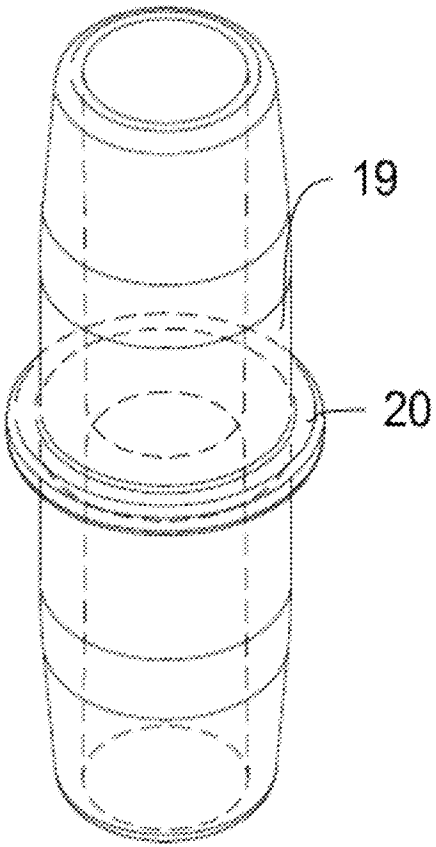
Figure 9:
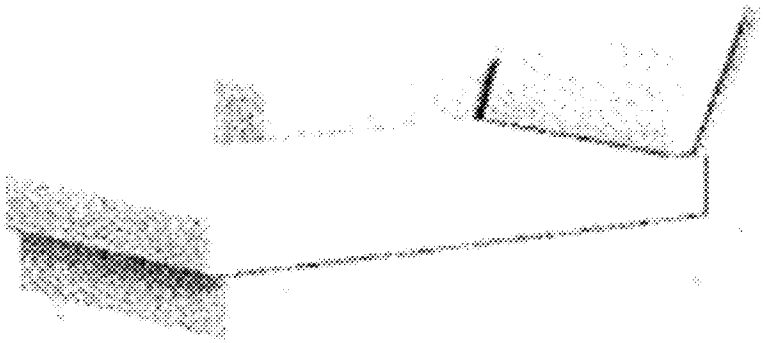
FIGS. 9 and 10 show examples of furnitures in perspective view, said furnitures including sitting arrangements according to the invention, realized as a longseat and a settee, respectively.
Figure 10:
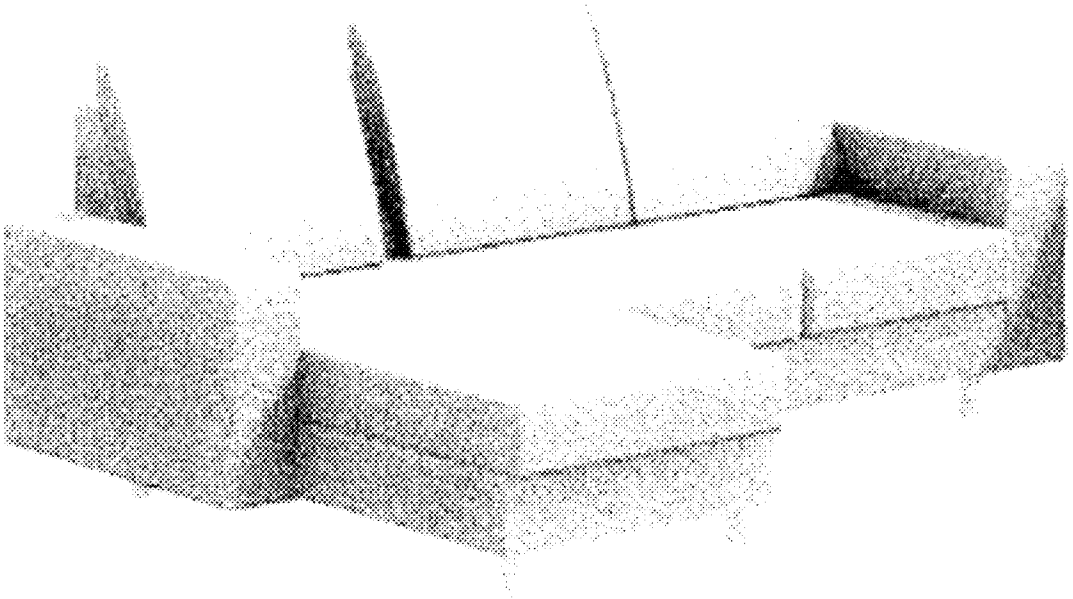

However, each hinge point 17*a, b* is preferably realized as an elastic joint as shown in FIGS. 8*a* and 8*b*. This is designed as a tubular body 19 in an elastic material. The joint is biconical or conical shaped towards both ends, and equipped with a collar 20 at the middle. The joint is preferably fully or partially closed with a wall 21 midway inside the tube. This joint is easy to mount as it is slided into the tubular ends of the frames. It consists of only one single piece and resists wear well. It will not squeak in use.

The invention claimed is:

1. A sitting arrangement, comprising:

a support frame including front and rear frame elements;

a seat part having a seat frame formed by sidebars, a front bar and rear bar;

a mounting mechanism articulately connecting the support frame to the seat part, the mounting mechanism being located below a sitting surface of the seat part and between the front frame element and a central axis through the seat part;

a backrest fixed to the support frame;

a flap hingedly coupled to the seat part at hinge points at a first flap end, and rotatably coupled to the support frame at mounting points at a second flap end opposite the first flap end; and a balance spring mounted between the seat part and the support frame, wherein the mounting mechanism is mounted asymmetrically to the seat part as compared to the central axis through the seat part, so that a hinge line will be located between knees and a hip of a user sitting on the sitting arrangement with parallel legs and a back of the user against the backrest, and the support frame includes first and second side elements, the mounting mechanism being located between at least one of the sidebars and at least one side element of the support frame.

2. The sitting arrangement according to claim 1, wherein, the seat frame or a protruding part thereof is located between at least one end stop of the support frame, the end stop or stops limiting a turning angle of the seat part.

3. The sitting arrangement according to claim 1, wherein the mounting mechanism is located about ⅓ of a distance from the front frame element to the rear frame element.

4. The sitting arrangement according to claim 1, wherein the seat part is adapted to tilt downwards 10 degrees maximum from a horizontal line.

5. A settee including the sitting arrangement according to claim 1.

6. The sitting arrangement according to claim 1, wherein the flap is connected to the seat part in elastic joints.

7. A chair including the sitting arrangement according to claim 1.

* * * * *